US005430946A

United States Patent [19]

Peters et al.

[11] Patent Number: 5,430,946

[45] Date of Patent: Jul. 11, 1995

[54] DEVICE FOR CIRCUMSCRIBING CIRCLES AND ELLIPSES

[75] Inventors: Alan R. Peters, Milford; Vincent T. Kozyrski, Plainville, both of Conn.

[73] Assignee: The Fletcher-Terry Company, Farmington, Conn.

[21] Appl. No.: 346,563

[22] Filed: Nov. 28, 1994

Related U.S. Application Data

[63] Continuation of Ser. No. 120,043, Sep. 10, 1993, abandoned.

[51] Int. Cl.[6] ..... B43L 11/055; B43L 9/04

[52] U.S. Cl. ..... 33/31; 33/27.032; 83/879; 30/310

[58] Field of Search ..... 33/30.1, 31, 27.03, 33/27.031, 27.032, 30.6; 82/1.3; 83/565, 879, 886; 30/164.95, 310, 300, 293, 286, 289, 294; 144/137

[56] References Cited

U.S. PATENT DOCUMENTS

| | | | |
|---|---|---|---|
| 532,155 | 1/1895 | Hottinger | 33/31 |
| 695,857 | 3/1902 | Bonner | 33/31 |
| 696,046 | 3/1902 | Hotchkiss | 33/31 |
| 830,784 | 9/1906 | Hanes | 33/31 |
| 884,762 | 4/1908 | Risting et al | 33/31 |
| 905,107 | 11/1908 | Schreiber | 33/31 |
| 2,039,584 | 5/1936 | Dixon | 33/31 |
| 2,458,208 | 1/1949 | Ryger | 33/31 |
| 2,512,786 | 6/1950 | Borg | 33/31 |
| 2,595,417 | 5/1952 | Scott | 33/31 |
| 2,762,126 | 9/1956 | Shaw | 33/31 |
| 2,790,240 | 4/1957 | Silverstein | 33/31 |
| 4,112,793 | 9/1978 | Pierce | 82/1.3 |
| 4,244,106 | 1/1981 | Pierce | 33/31 |
| 4,567,927 | 2/1986 | Plamann | 33/31 |
| 5,099,727 | 3/1992 | Kozyrski et al. | 82/1.3 |
| 5,233,748 | 8/1993 | Logan et al. | 33/30.6 |

*Primary Examiner*—Thomas B. Will
*Attorney, Agent, or Firm*—Ira S. Dorman

[57] ABSTRACT

A device for circumscribing selectively both circles and also ellipses of variable proportions includes a housing in which is rotatably mounted an armature. The armature is constrained to move on two axes disposed at right angles to one another, so as to enable elliptical shapes to be generated. One such axis is provided by a rectilinear channel in the base of the device, in which is engaged a follower operatively attached to the armature; the other axis is provided by a rectilinear slot formed through the cover of the device. A hub is engaged in the cover slot and is assembled with the armature; it can be moved to any selected position along a rectilinear axis of the armature without disassembly, and can be secured in position by tightening of a clamping mechanism. In one position the axes of rotation of the hub and the armature are aligned, to thereby cause the device to circumscribe a circle; in other positions the axes are offset, thereby conditioning the device for circumscribing ellipses.

19 Claims, 6 Drawing Sheets

DEVICE FOR CIRCUMSCRIBING CIRCLES AND ELLIPSES

This is a continuation of application Ser. No. 08/120,043 filed on Sep. 10, 1993 now abandoned.

BACKGROUND OF THE INVENTION

Sheets of cardboard mat, glass and other materials are frequently cut to provide components having openings and/or perimeters of circular or elliptical (generally referred to in the trade as "oval") configuration. Such components are widely used for mounting and framing of pictures and the like.

Machines are known in the art, and are commercially available, for cutting planar workpieces to such shapes. Exemplary are the devices described in Pierce U.S. Pat. No. 4,112,793, issued Sep. 12, 1978, and in Kozyrski et al U.S. Pat. No. 5,099,727, issued Mar. 31, 1992, both of which employ mechanisms that implement the so-called "Scottish yoke" principle by having the functional components (e.g., the cutting head) operatively mounted on a rotating member that is constrained to reciprocate on two perpendicular axes. Hand-held scribing, drafting and cutting devices incorporating such mechanisms are also known in the art and are commercially available, as shown for example in Ruger U.S. Pat. No. 2,458,208, issued Jan. 4, 1949; Scott U.S. Pat. No. 2,595,417, issued May 6, 1952; Shaw U.S. Pat. No. 2,762,126, issued Sep. 11, 1956; and Pierce U.S. Pat. No. 4,244,106, issued January 1981.

Machines and devices of the character described are generally capable of defining circular, as well as elliptical, shapes, the generation of a circle merely being a matter of setting a zero differential (or offset) between major and minor axis lengths. A serious drawback in DIY (do-it-yourself) apparatus of this kind, made available heretofore, resides in this aspect; i.e., in the difficulty entailed in reconfiguring the device between its circle- and ellipse-defining modes of operation.

SUMMARY OF THE INVENTION

Accordingly, it is the broad object of the present invention to provide a novel DIY device that is capable of circumscribing circles as well as ellipses of selected proportions, wherein reconfiguration, as between the circle- and ellipse-defining modes, is achieved readily and easily and without need for disassembly of the device.

Further objects of the invention are to provide a device having the foregoing features and advantages which is in addition accurate and convenient to use, is relatively inexpensive and facile to manufacture and assemble, and is especially well suited for use in cutting applications.

It has now been found that the foregoing and related objects of the invention are attained by the provision of a device comprising a housing having marginal elements that form a rectilinear slot on a first axis, and structure that forms a channel on a second axis, the first and second axes being mutually perpendicular and lying in parallel planes. An armature is rotatably mounted in the housing, and a follower is slidably engaged in the channel thereof; means is provided for attaching the armature to the follower for rotation about a third axis normal to the planes in which the first and second axes lie. The device also includes a hub that is interengagable with the armature at selected different positions along a rectilinear axis that passes through, and lies perpendicular to, the "third" axis. The hub extends through the slot of the housing on a fourth axis that lies parallel to the "third" axis and is aligned coaxially therewith in one of the selected hub positions. The hub bears substantially upon the marginal, slot-defining elements of the housing, and cooperates with the follower to constrain the armature to reciprocal movement on the "first" and "second" axes. The means for interengaging permits ready variation of the position of the hub, and establishes the amount of displacement that occurs between the "fourth" axis and the "second" axis during armature rotation.

In preferred embodiments, the means for interengaging will comprise a slot that extends along the rectilinear axis of the armature, and clamping means that is operatively disposed on the hub, the hub being securable at any selected point along the length of the slot. Indicia will usually be provided along the armature slot, for indicating the distance between the "third" and "fourth" axes. The housing will most desirably have an upper portion providing slot-defining marginal elements, and a lower portion providing channel-forming structure, the armature being disposed in a space therebetween. The armature will advantageously have a circular recess formed into its lower portion, with the follower comprising a block portion slidably seated in the channel of the housing and a disc portion rotatably seated in the armature recess.

The underside of the lower portion of the device will normally have means for stabilizing its position, as well as having reference elements for assisting in angularly orienting the device on the underlying surface. In especially preferred embodiments the clamping means will comprise a clamping assembly at the lower end of the hub, and an operatively connected clamp-operating member accessible from the upper end. The device may further include a beam that extends radially from the hub for slidably mounting a functional head assembly (such as for cutting), the latter having means for affixing it at selected locations to enable ready variation of its spacing from the "fourth" axis.

DETAILED DESCRIPTION OF THE ILLUSTRATED EMBODIMENT

Figures 1, 2:
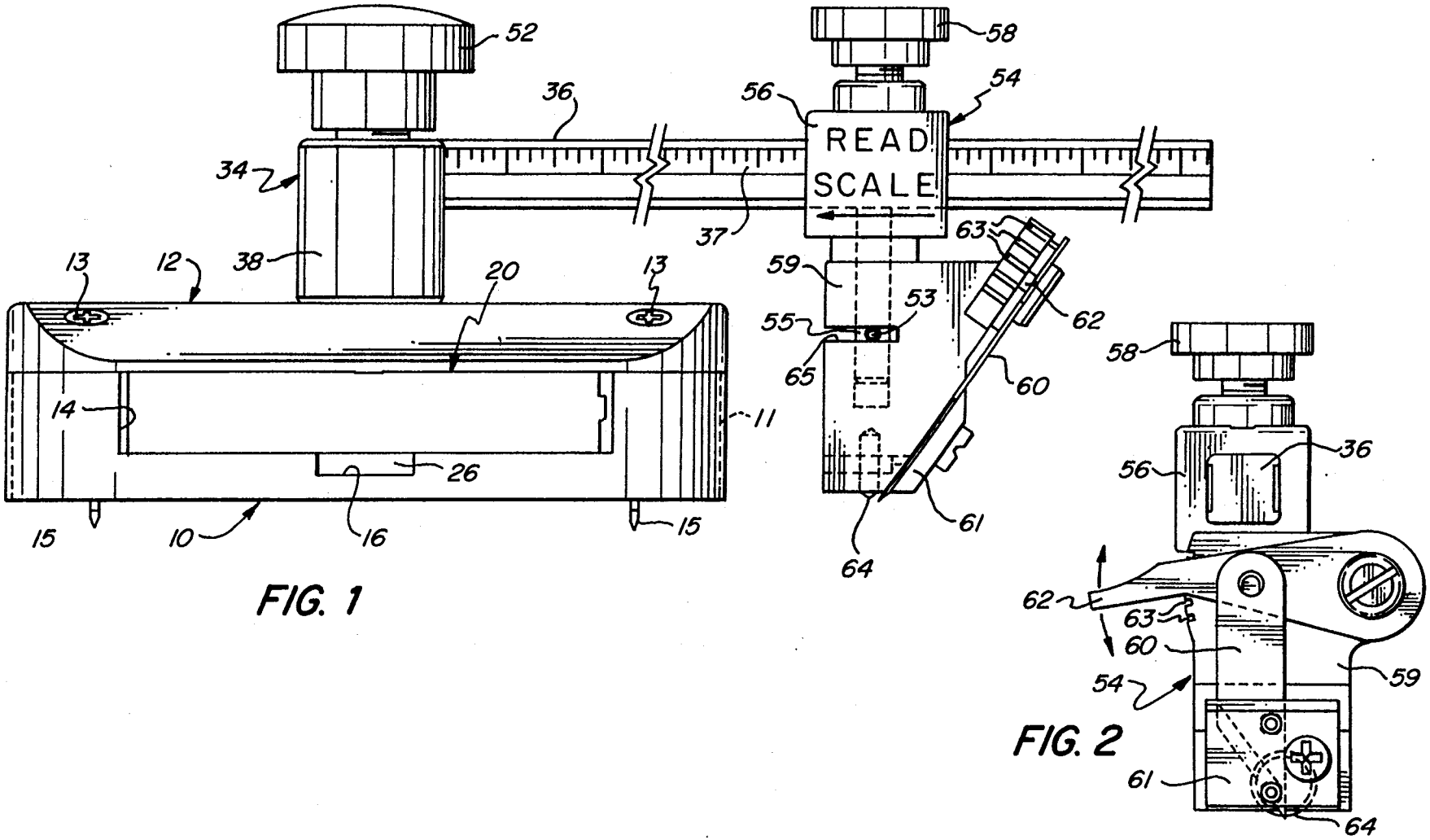
FIG. 1 of the drawings is a fragmentary elevational view of a cutting device embodying the present invention.
FIG. 2 is an end view showing the cutting head assembly employed in the device of FIG. 1.
Figure 3:
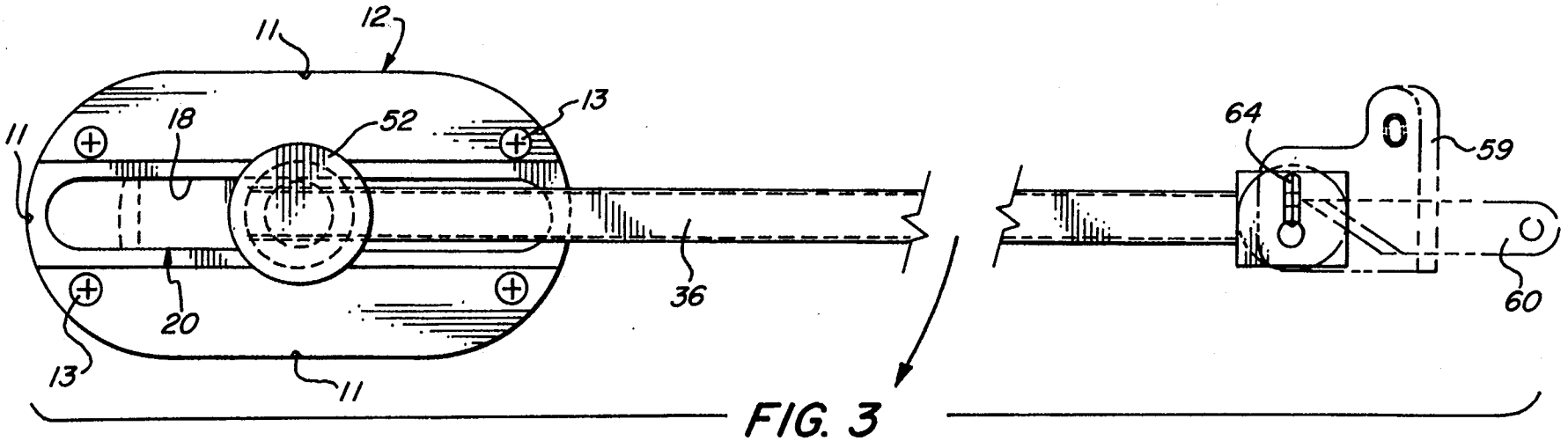
FIG. 3 is a plan view of the device of FIG. 1, drawn to a diminished scale and showing only part of the cutting head assembly.
Figure 10C:
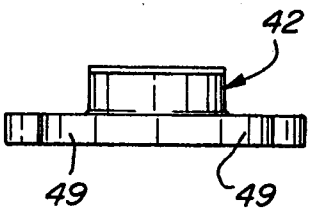
FIGS. 10A, 10B and 10C are, respectively, plan, side elevational, and end elevational views of the lower clamping plate employed in the hub assembly.
Figure 10B:
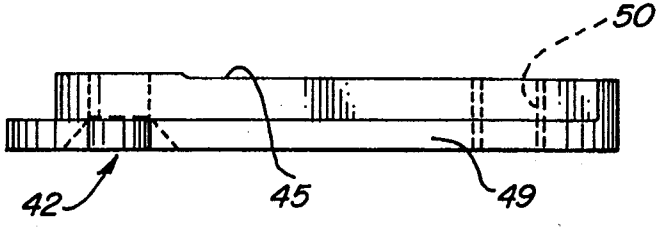
Figure 10A:
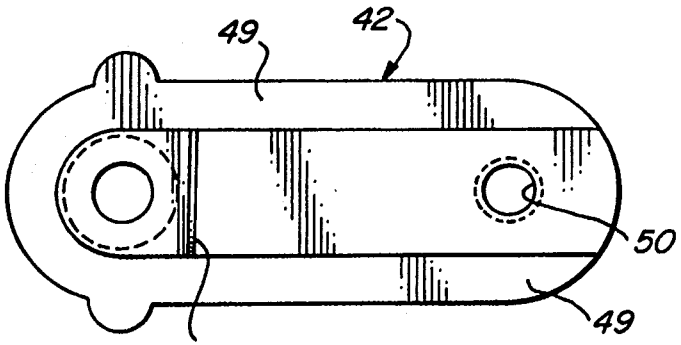

Turning now in detail to the appended drawings, therein illustrated is a circle- and ellipse-cutting device embodying the present invention. The device includes a support unit consisting of a base and a cover, generally designated respectively by the numerals 10 and 12, disengagably assembled with one another by a number of screw fasteners 13. The base 10 is recessed at 14 to provide, in cooperation with the cover 12, a passage through the unit, and a rectilinear slot 16 extends from the lower wall surface defining the recess 14, transversely across the base. Marginal elements of the cover form a rectilinear slot 18, which extends in a plane parallel to the plane in which the channel 16 extends and on an axis perpendicular to the axis thereof.

An elongate armature, generally designated by the numeral 20, is disposed within the space 14 between the base 10 and cover 12 of the body. It has a circular recess 22 formed upwardly into its bottom surface, in which recess is seated the disc portion 24 of a follower. The follower also includes an integral, elongate slide bar portion 26, which is of rectangular cross-section and extends diametrically across the disc portion 24. The bar portion 26 is slidably seated in the channel 16 of the base 10, and serves to constrain the armature to movement along the rectilinear axis of the slot 16 while permitting its rotation about the disc portion 24.

The armature 20 is itself formed with a longitudinal rectilinear slot 28, which extends inwardly from one end to bifurcate the armature into parallel leg portions 20'. The slot is defined by marginal elements 30 of reduced cross-section (relative to the thickness of the adjacent structure) on each leg portion, the elements 30 being grooved at 31 along their upper surfaces; a distance scale 32 extends along one of the marginal elements 30.

The device also includes a hub assembly, generally designated by the numeral 34, having a beam 36 attached to, and extending radially from, a cylindrical hub 38. An upper, offsetting clamping plate 40 is attached to a reduced-diameter section 39 at the lower end of the hub 38 by screws (not shown) received in the apertures 41, and extends laterally therefrom. A cooperating lower clamping plate or nut, generally designated by the numeral 42 and substantially of straight-sided oval form, is generally coextensive with the upper plate 40 and is joined thereto by a connecting screw 44. The threaded shank 46 of a clamping knob 52 extends through the bore 48 of the hub 38 and the aperture 43 of the upper plate 40, and into engagement in the threaded aperture 50, formed adjacent the end of the lower clamping plate 42 remote from the screw 44.

As will be appreciated, tightening of the knob 52 will cause the lower plate 42 to flex upwardly (being relieved at 45 to accommodate such action), thereby generating a clamping force. The inner edges of the marginal portion 30 along the slot 28 of the armature 20 lie between the marginal portions 47 and 49 of the two clamping plates 40, 42, respectively, and hence are gripped thereby when the knob 52 is tightened, thus enabling selective positioning of the hub 38 at any point along the length of the slot 28. The upper plate 40 has a pair of parallel ribs 51 extending therealong and seated in the grooves 31; spreading of the leg portions 20' of the armature 20 is thereby prevented.

Figure 4:
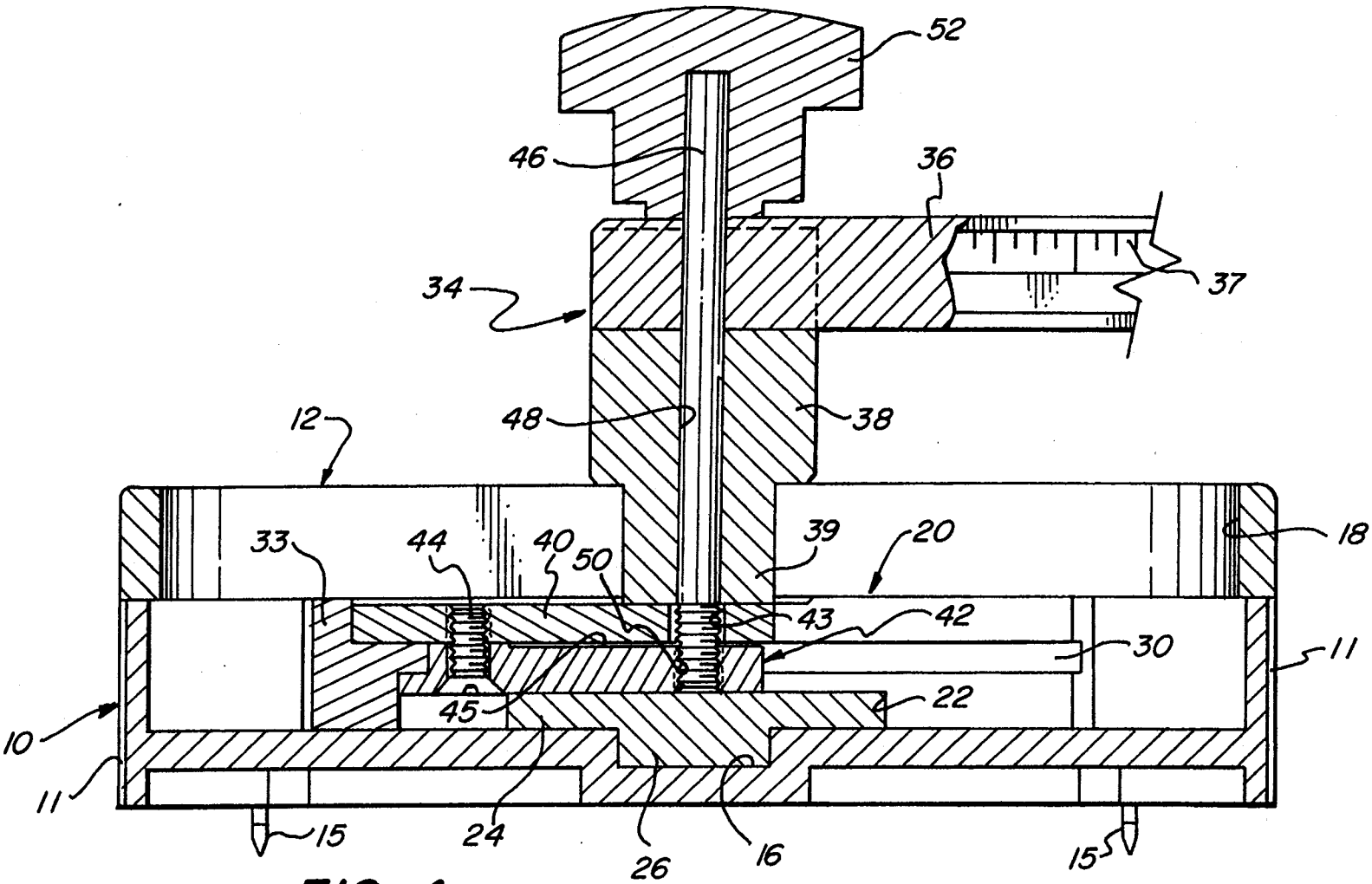
FIG. 4 is a fragmentary sectional view of the device of the foregoing Figures, taken along line 4—4 of FIG. 3 and drawn to the scale of FIG. 1, the device as depicted being set for cutting circles.
Figure 6:
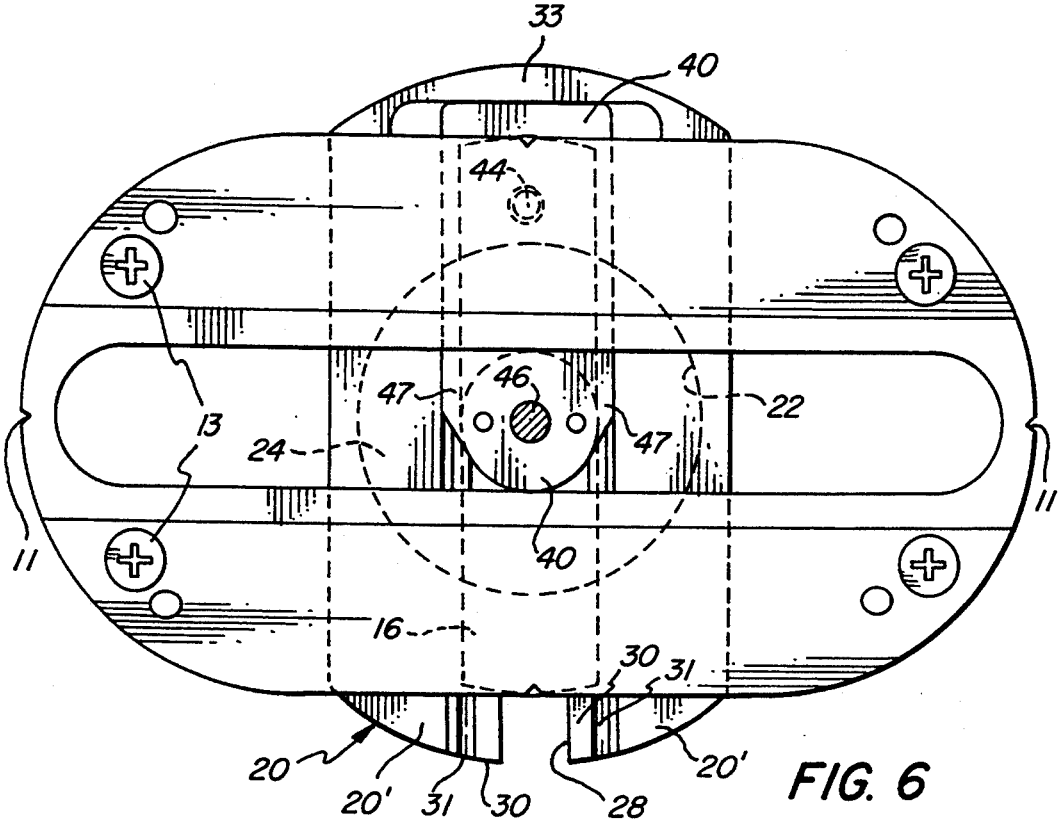
FIG. 6 is a plan view of the device, set and oriented as in FIG. 5.
Figure 5:
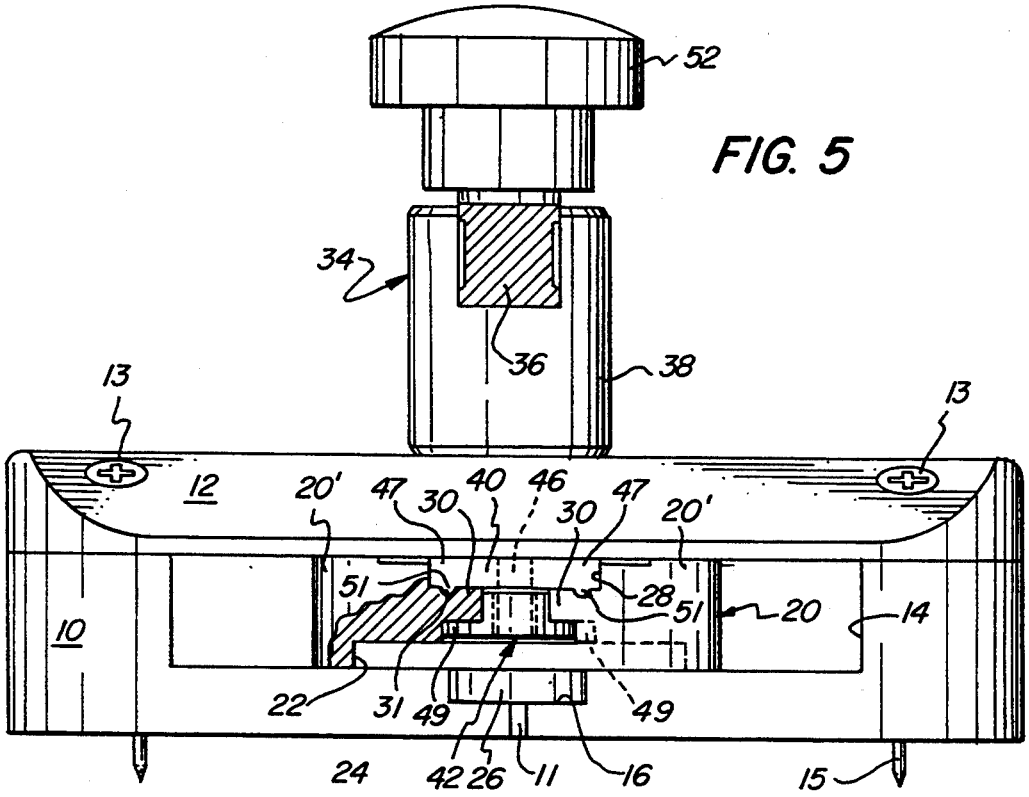
FIG. 5 is an elevational view of the device in partial section, the device being set as in FIG. 4 and with the cutting assembly rotated 90° therefrom, in a clockwise direction as viewed from above.

It is to be noted that the slot 28 extends beyond the axis of rotation of the armature 20 on the follower disc 24. This makes it possible to align the axis of the hub 34 directly on the axis of rotation of the armature 20, as shown in FIGS. 4 and 6 of the drawings. The marginal element 33, defining the end of the slot 28, is so formed as to establish that coaxial relationship directly when the end of the upper plate 40 is brought into abutment against the element 33.

A pivoting cutting head assembly, generally designated by the numeral 54, includes a mounting block 56 slidably supported on the beam 36 and receiving a clamping knob 58 for securing the head in any selected position (using the edge of the block 56 indicated by the "READ SCALE" marking, and the scale 37 on the beam 36). A post 55 extends downwardly from the block 56 and supports the body 59, engagement of the cross-pin 53 in the slot 65 thereof serving to permit its limited pivotal movement. A blade 60 is firmly and slidably held in place against the body 59 by a clamping plate 61. Lever arm 62 engages the blade 60 and is raised and lowered to control the extent of blade projection, the series of nicks 63 in the edge of the body 59 being used for reference purposes. A small roller 64 is mounted adjacent the blade 60, and serves to steer the body 59 of the head assembly 54 as it is caused to circumscribe the supporting housing.

In use, the device is of course first properly oriented on the workpiece by reference to the grooves 11 on the base 10, following which force is applied to cause the small locating pins 15 to penetrate the surface. Moving the head assembly 54 about the supporting unit will cause it to follow either a circular or an elliptical path, depending upon the position of the hub 38 on the armature 20 and as controlled by the incorporated Scottish yoke mechanism.

Figure 8:
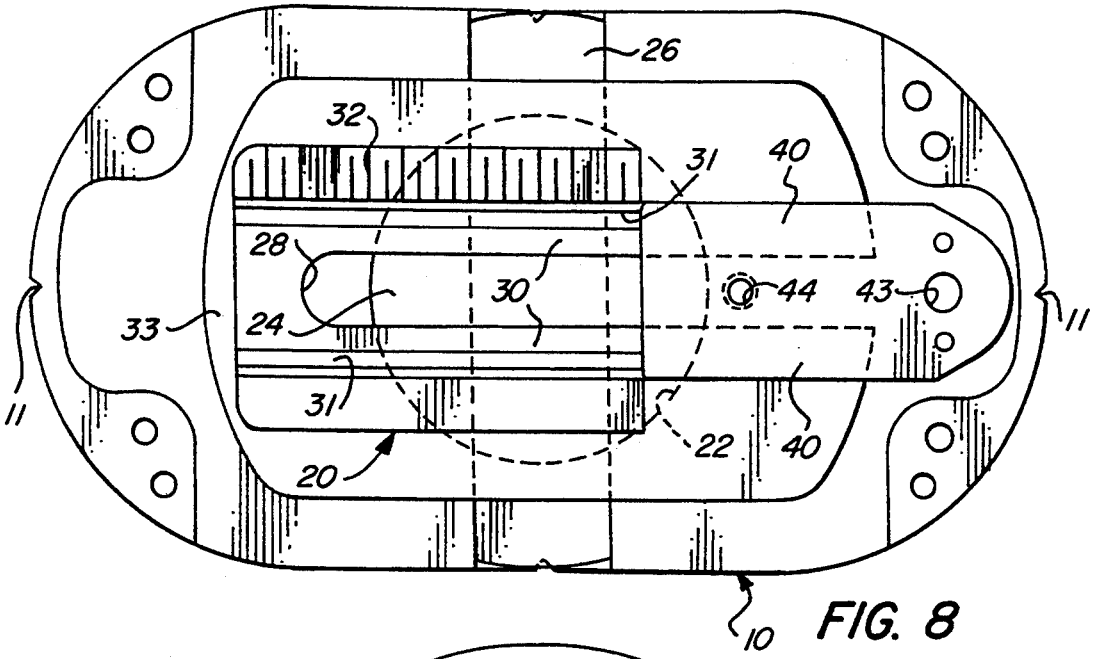
FIG. 8 is a view similar to FIG. 7, with the device shown in a position 90° ahead of that of FIG. 8, considered in its normal, clockwise direction of rotation.
Figure 7:
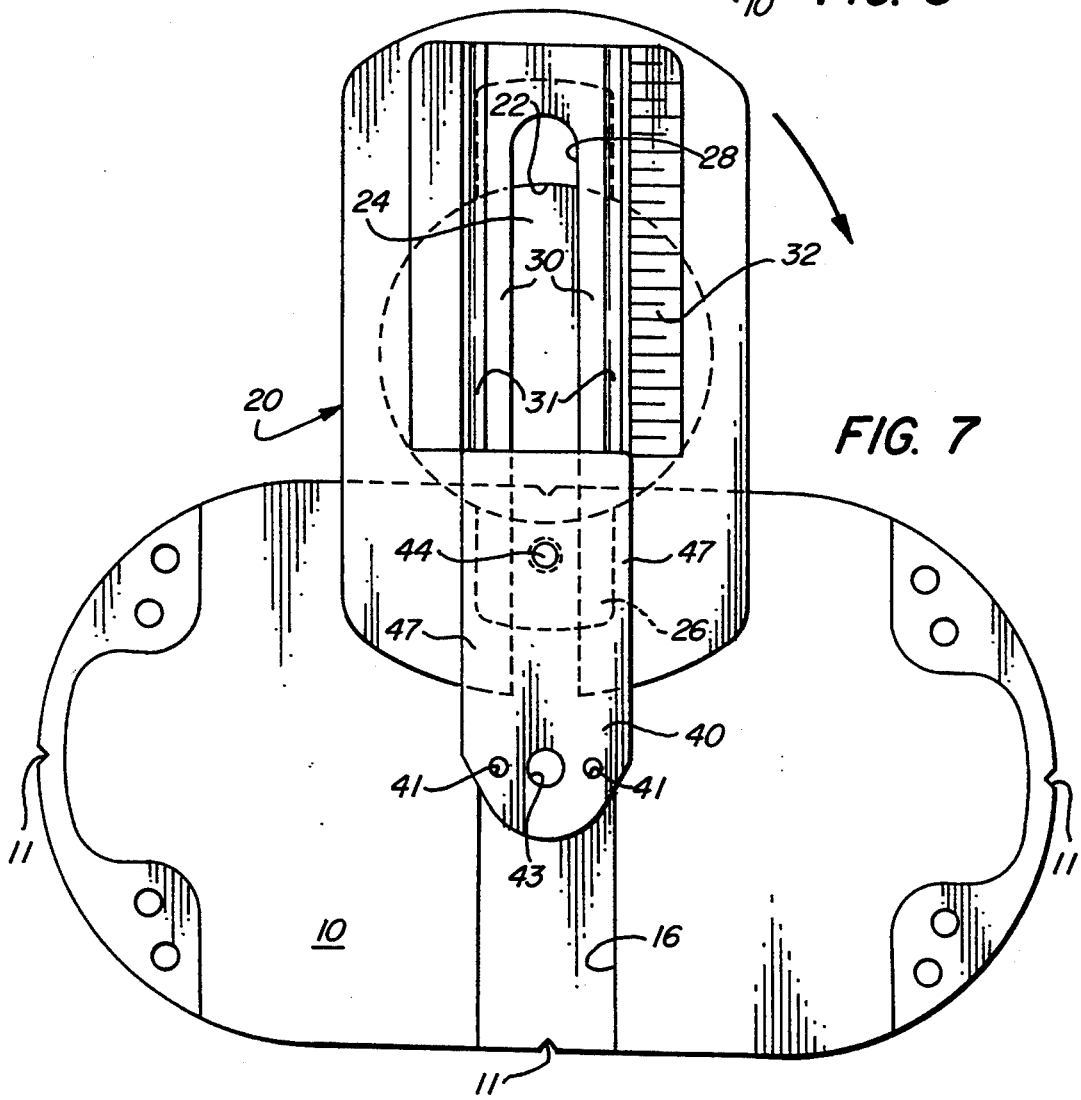
FIG. 7 is a view similar to FIG. 6, with the cover and hub assembly removed and with the device set for cutting elliptical shapes of maximum major axis/minor axis offset value.
Figure 9:
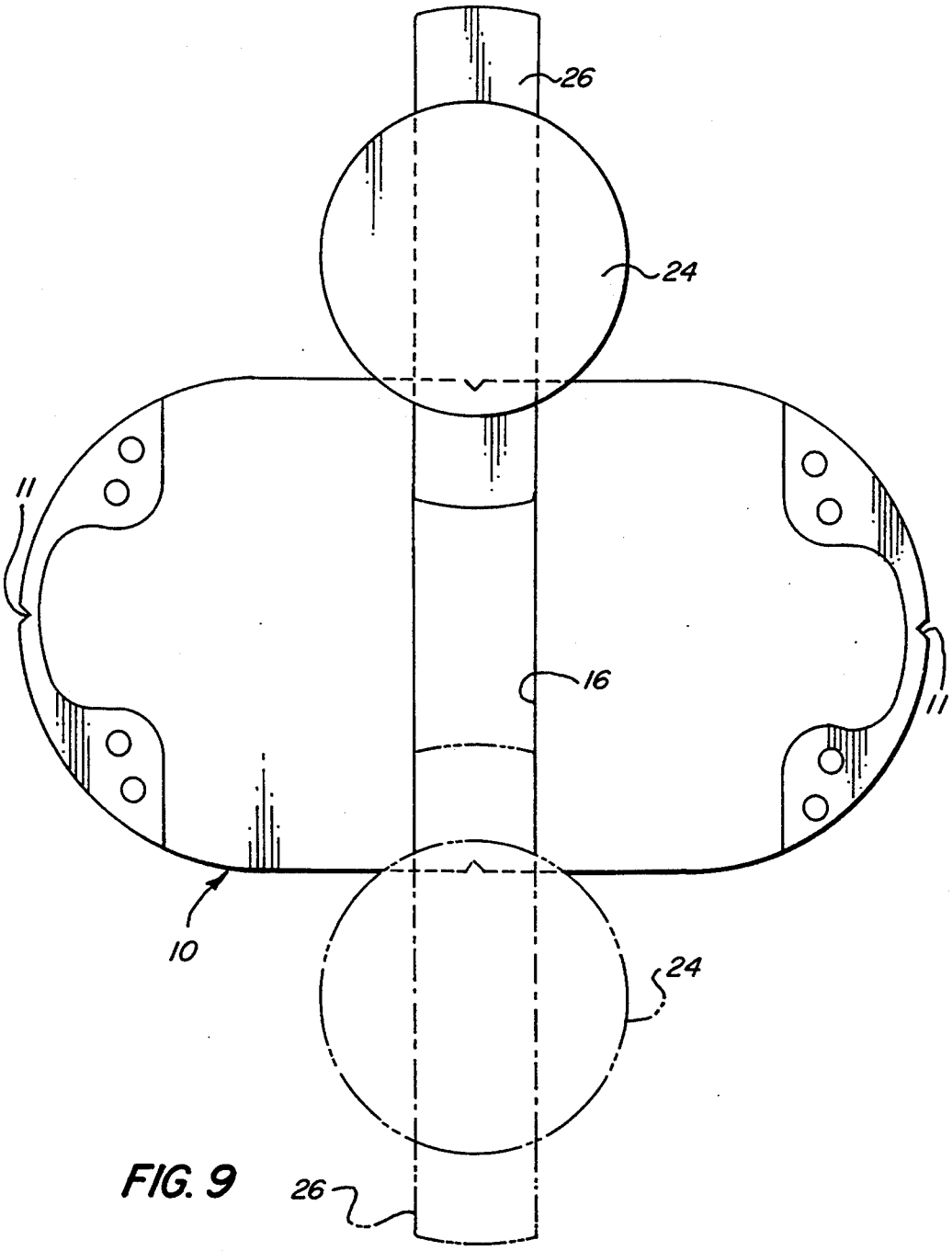
FIG. 9 is a plan view of the base of the housing and the follower engaged therewith, the position of the follower, as shown in full line, corresponding to the orientation of FIG. 7 and, as shown in phantom line, corresponding to a 180° displaced orientation.

More particularly, when the hub 38 is positioned with its axis aligned coaxially with the axis of rotation of the follower disc 24, as in FIGS. 1, 3, and 4 through 6, there will be no migration of the armature 20 and consequently the cutting head assembly 54 will circumscribe a circle. Affixing the axis of the hub 38 at a position displaced from that of the disc 24, as in FIGS. 7 through 9, will on the other hand produce reciprocation of the armature 20 along the axes of the base channel 16 and the cover slot 18 as it rotates, and will thereby cause the head assembly 54 to circumscribe an elliptical path. The major axis of the resultant ellipse will be greater than its minor axis by an amount that corresponds to the offset of the hub axis from the axis of armature rotation, which distance may of course be set with reference to the scale 32. Needless to say, the actual lengths of the axes of a circumscribed ellipse, or the diameter of a circumscribed circle, as the case may be, will be determined by the position of the head assembly 54 on the beam 36; here again, the distance scale 37 will facilitate selective positioning.

Structural variations and functional equivalencies are of course contemplated. For example, reference herein to a channel in the base of the housing should be construed broadly enough to encompass alternative structures (e.g., slot-defining elements) that can serve to constrain a follower. Similarly, modification of the relative positions of certain components, from the arrangement depicted, may be found desirable and is deemed to be within the scope of the appended claims.

Thus, it can be seen that the present invention provides a novel DIY device that is capable of circumscribing circles, as well as ellipses of selected proportions. Reconfiguration, as between circle- and ellipse-defining functions, is accomplished readily and easily and without need for disassembly of the device; location of the hub coaxially with the axis of rotation of the armature, or at any other point along the armature slot, is achieved simply by loosening of the clamping knob and sliding the hub to the selected position. The device is accurate and convenient to use, is relatively inexpensive and facile to manufacture and assemble, and is especially well suited for cutting applications, albeit that heads adapted for other purposes (e.g., scribing, scoring and drafting) may also be employed.

Having thus described the invention, what is claimed is:

1. In a device for circumscribing selectively both circles and also ellipses of variable proportions, the combination comprising: a housing having marginal elements forming a rectilinear slot on a first axis, and having structure forming a channel on a second axis perpendicular to said first axis and in a plane parallel to the plane in which said first axis lies; an armature rotatably mounted in said housing; a follower slidably engaged in said channel of said housing; means for attaching said armature to said follower for relative rotation of said armature about a third axis normal to said parallel planes; a hub assembled with said armature; means for selectively interengaging said hub and said armature at each of a plurality of different positions of said hub along a rectilinear axis of said armature extending through and perpendicular to said third axis, said hub extending on a fourth axis that lies parallel to said third axis and is aligned coaxially with said third axis in one of said different positions of said hub, said hub extending through said slot and having a surface bearing substantially upon said marginal elements of said housing, said hub and said follower, engaged respectively in said slot and said channel, constraining said armature to reciprocal movement on said first and second axes during rotation thereof, said means for interengaging comprising engaging means disposed operatively on said hub and including engaging elements displaced laterally from said fourth axis along said rectilinear axis, and permitting ready variation of said positions of said hub, and thereby of any displacement of said hub from said second axis during rotation of said armature, without disassembly of said hub from said armature.

2. The device of claim 1 wherein said means for interengaging comprises a slot extending along said rectilinear axis of said armature, said hub being securable to said armature at all points along the length of said slot.

3. The device of claim 2 wherein said armature has an element thereon for preventing displacement of said hub in one direction along said axis of said armature beyond said one position.

4. The device of claim 2 wherein indicia are provided along said slot of said armature for indicating the distance between said third and fourth axes.

5. The device of claim 1 wherein said housing has an upper portion on which said marginal elements are provided, a lower portion on which said channel-forming structure is provided, and a space therebetween in which said armature is disposed.

6. The device of claim 5 wherein said lower portion has an underside on which is provided means for stabilizing the position of said device upon an underlying surface, and wherein said lower portion has reference elements thereon for angularly orienting said device on such an underlying surface.

7. The device of claim 2 wherein said hub has upper and lower end portions, and wherein said engaging means includes a clamping assembly disposed at said lower end portion of said hub and a clamp-operating member operatively connected to said clamping assembly and accessible from said upper end portion of said hub.

8. The device of claim 1 further including a mounting beam extending radially from said hub with respect to said fourth axis.

9. The device of claim 8 further including a functional head slidably mounted on said beam and having means for affixing said head at selected locations along said beam, whereby the location of said head relative to said fourth axis can be varied readily.

10. The device of claim 3 wherein said slot opens through said armature at a location opposite said element for preventing displacement, the opening permitting displacement of said hub beyond said armature in the direction opposite said one direction.

11. In a device for circumscribing selectively both circles and also ellipses of variable proportions, the combination comprising: a housing having marginal elements forming a rectilinear slot on a first axis, and having structure forming a channel on a second axis perpendicular to said first axis and in a plane parallel to the plane in which said first axis lies; an armature rotatably mounted in said housing; a follower slidably engaged in said channel of said housing; means for attaching said armature to said follower for relative rotation of said armature about a third axis normal to said parallel planes; a hub assembled with said armature; means for selectively interengaging said hub and said armature at each of a plurality of different positions of said hub along a rectilinear axis of said armature extending through and perpendicular to said third axis, said hub extending on a fourth axis that lies parallel to said third axis and is aligned coaxially with said third axis in one of said different positions of said hub, said hub extending through said slot and having a surface bearing substantially upon said marginal elements of said housing, said hub and said follower, engaged respectively in said slot and said channel, constraining said armature to reciprocal movement on said first and second axes during rotation thereof, and said means for interengaging permitting ready variation of said positions of said hub, and thereby of any displacement of said hub from said second axis during rotation of said armature, without disassembly of said hub from said armature, said housing having an upper portion on which said marginal elements are provided, a lower portion on which said channel-forming structure is provided, and a space therebetween in which said armature is disposed, said armature having a lower portion with a circular recess formed therein, and said follower comprising a block portion slidably seated in said channel of said housing, and a fixedly attached disc portion rotatably seated in said recess of said armature.

12. The device of claim 11 wherein said means for interengaging comprises a slot extending along said rectilinear axis of said armature, and engaging means disposed operatively on said hub, said hub being securable to said armature at all points along the length of said slot.

13. The device of claim 12 wherein said armature has an element thereon for preventing displacement of said hub in one direction along said axis of said armature beyond said one position.

14. The device of claim 12 wherein indicia are provided along said slot of said armature for indicating the distance between said third and fourth axes.

15. The device of claim 11 wherein said lower portion has an underside on which is provided means for stabilizing the position of said device upon an underlying surface, and wherein said lower portion has reference elements thereon for angularly orienting said device on such an underlying surface.

16. The device of claim 12 wherein said hub has upper and lower end portions, and wherein said engaging means includes a clamping assembly disposed at said lower end portion of said hub and a clamp-operating member operatively connected to said clamping assembly and accessible from said upper end portion of said hub.

17. The device of claim 11 further including a mounting beam extending radially from said hub with respect to said fourth axis.

18. The device of claim 17 further including a functional head slidably mounted on said beam and having means for affixing said head at selected locations along said beam, whereby the location of said head relative to said fourth axis can be varied readily.

19. In a device for circumscribing selectively both circles and also ellipses of variable proportions, the combination comprising: a housing having marginal elements forming a rectilinear slot on a first axis, and having structure forming a channel on a second axis perpendicular to said first axis and in a plane parallel to the plane in which said first axis lies; an armature rotatably mounted in said housing; a follower slidably engaged in said channel of said housing; means for attaching said armature to said follower for relative rotation of said armature about a third axis normal to said parallel planes; a hub assembled with said armature; means for selectively interengaging said hub and said armature at each of a plurality of different positions of said hub along a rectilinear axis of said armature extending through and perpendicular to said third axis, said hub extending on a fourth axis that lies parallel to said third axis and is aligned coaxially with said third axis in one of said different positions of said hub, said hub extending through said slot and having a surface bearing substantially upon said marginal elements of said housing, said hub and said follower, engaged respectively in said slot and said channel, constraining said armature to reciprocal movement on said first and second axes during rotation thereof, and said means for interengaging comprising engaging means disposed operatively on said hub and including engaging elements displaced laterally from said fourth axis along said rectilinear axis, and permitting ready variation of said positions of said hub, and thereby of any displacement of said hub from said second axis during rotation of said armature, without disassembly of said hub from said armature, said housing having an upper portion on which said marginal elements are provided, a lower portion on which said channel-forming structure is provided, and a space therebetween in which said armature is disposed, said armature having a lower portion with a circular recess formed therein, and said follower comprising a block portion slidably seated in said channel of said housing, and a fixedly attached disc portion rotatably seated in said recess of said armature.

* * * * *